US007155972B2

(12) United States Patent
Kosugi

(10) Patent No.: US 7,155,972 B2
(45) Date of Patent: Jan. 2, 2007

(54) EXPENDABLES CONTAINER CAPABLE OF MEASURING RESIDUAL AMOUNT OF EXPENDABLES

(75) Inventor: Yasuhiko Kosugi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 65 days.

(21) Appl. No.: 10/531,727

(22) PCT Filed: Jun. 25, 2004

(86) PCT No.: PCT/JP2004/009408

§ 371 (c)(1),
(2), (4) Date: Apr. 18, 2005

(87) PCT Pub. No.: WO2005/000591

PCT Pub. Date: Jan. 6, 2005

(65) Prior Publication Data

US 2006/0007253 A1 Jan. 12, 2006

(30) Foreign Application Priority Data

Jun. 26, 2003 (JP) ..... 2003-182354

(51) Int. Cl.
*B41J 2/95* (2006.01)

(52) U.S. Cl. ..... 73/290 V; 347/7

(58) Field of Classification Search ..... None
See application file for complete search history.

(56) References Cited

U.S. PATENT DOCUMENTS

2005/0237349 A1* 10/2005 Nishihara ..... 347/7

FOREIGN PATENT DOCUMENTS

| | | | |
|---|---|---|---|
| JP | 62-095225 | A | 5/1987 |
| JP | 06-008427 | A | 1/1994 |
| JP | 07-137276 | A | 5/1995 |
| JP | 10-305590 | A | 11/1998 |
| JP | 2001-146019 | A | 5/2001 |
| JP | 2001-147146 | A | 5/2001 |
| JP | 2001-328275 | A | 11/2001 |
| JP | 2002-156270 | A | 5/2002 |
| JP | 2002-241450 | A | 8/2002 |

* cited by examiner

*Primary Examiner*—Robert Raevis
(74) *Attorney, Agent, or Firm*—Sughrue Mion, PLLC

(57) ABSTRACT

This invention is an apparatus configured to receive expendable from an expendable container with a piezoelectric element attached. This apparatus has a detection signal generation circuit configured to charge and discharge the piezoelectric element, and generate a detection signal including information representing a cycle of remaining vibration of the piezoelectric element after a lapse of a predetermined standby time from a completion of the discharge; and a controller configured to generate a clock signal, and control the charge and the discharge of the piezoelectric element. The cycle is available for determining whether a residual quantity of the expendable is greater than a preset level. The controller is configured to determine the predetermined standby time by counting a number of pulses in the clock signal.

9 Claims, 10 Drawing Sheets

Applied Voltage Of Piezoelectric Element In Time Domain
(Discharge Time)

Applied Voltage of Piezoelectric Element
in Frequency Domain

Frequency Response Function
(Transfer Function) Of Sensor Structure

Vibration Voltage and Transfer Function of Sensor in Frequency Domain

Output Voltage of Sensor in Frequency Domain

EXPENDABLES CONTAINER CAPABLE OF MEASURING RESIDUAL AMOUNT OF EXPENDABLES

TECHNICAL FIELD

The present invention relates to a manufacturing technique of expendable container with function of measuring residual quantity of expendable.

BACKGROUND ART

Inkjet printers have widely been used as the output device of the computer. Ink as an expendable for the inkjet printer is generally kept in an ink cartridge. One proposed method of measuring the residual quantity of ink kept in the ink cartridge utilizes a piezoelectric element to attain direct measurement, as disclosed in Japanese Patent Laid-Open Gazette No. 2001-147146.

This proposed method first applies a voltage wave to the piezoelectric element attached to the ink cartridge to vibrate a vibrating element of the piezoelectric element. The method then detects a variation in cycle of counter electromotive force, which is caused by remaining vibration in the vibrating element of the piezoelectric element after a lapse of standby time for damping the unnecessary vibration as noise, to measure the residual quantity of the expendable.

This prior art method, however, determines the standby time by counting the voltage wave output from the piezoelectric element, and therefore may underestimate the standby time when the noise is large enough to count even the voltage wave as noise. As a result, the noise cannot be damped sufficiently, and thereby deteriorating the reliability of the measurement.

DISCLOSURE OF THE INVENTION

The object of the invention is thus to eliminate the above problems of the prior art technique and to provide a technique of enhancing reliability of measurement in an expendable container that utilizes a piezoelectric element to measure a residual quantity of expendable kept therein.

The first configuration of the invention provides an apparatus configured to receive expendable from an expendable container with a piezoelectric element attached. The apparatus comprises a detection signal generation circuit configured to charge and discharge the piezoelectric element, and generate a detection signal including information representing a cycle of remaining vibration of the piezoelectric element after a lapse of a predetermined standby time from a completion of the discharge; and a controller configured to generate a clock signal, and control the charge and the discharge of the piezoelectric element. The cycle is available for determining whether the residual quantity of the expendable is greater than a preset level. The controller is configured to determine the predetermined standby time by counting a number of pulses in the clock signal.

In the first application of the invention, the standby time from the end of discharge of piezoelectric element to the start of detection of remaining vibration is determined by counting the number of pulses of the clock signal, and thereby reducing the variation in the standby time due to the manufacturing variability of piezoelectric element unlike the method of determining the standby time based on the voltage wave output from the piezoelectric element. This arrangement desirably enhances the reliability of the measurement.

In a preferred apparatus of the invention, the controller is capable of changing the predetermined standby time. This arrangement may set the appropriate standby time depending on the manufacturing variability of expendable container.

The second configuration of the invention provides an expendable container capable of measuring a residual quantity of stored expendable. The expendable container comprises an expendable tank configured to store the expendable and have a piezoelectric element attached; a detection signal generation circuit configured to charge and discharge the piezoelectric element, and generate a detection signal including information representing a cycle of remaining vibration of the piezoelectric element after a lapse of a predetermined standby time from a completion of the discharge; and a controller configured to generate a clock signal, and control the charge and the discharge of the piezoelectric element. The cycle is available for determining whether the residual quantity of the expendable is greater than a preset level. The controller is configured to determine the predetermined standby time by counting a number of pulses in the clock signal.

In this manner, the expendable container may include the detection signal generation circuit and the control module.

In the above expendable container, the controller may be capable of changing the predetermined standby time. The controller further generates the clock signal in response to a signal provided from outside of the expendable container.

The third configuration of the invention provides an expendable container capable of measuring a residual quantity of stored expendable. The expendable container comprises an expendable tank configured to store the expendable and a piezoelectric element attached to the expendable tank. The piezoelectric element is configured to charge and discharge in response to an electric current provided from an outside apparatus, and output a voltage wave only in an predetermined frequency in response to a remaining vibration after a lapse of a predetermined standby time from a completion of the discharge. The predetermined frequency is available for determining whether a residual quantity of the expendable is greater than a preset level. The predetermined standby time is determined by counting a number of pulses in a clock signal generated by the outside apparatus.

In the third application of the invention, the piezoelectric element attached to the expendable container outputs the voltage wave only in the predetermined cycle after a lapse of the predetermined standby time, and thereby improving the reliability of the measurement in cooperation with the method of determining by counting the number of pulses of the clock signal during the predetermined standby time.

Where the "outputting the voltage wave only in the predetermined cycle" means that the voltage wave is output in the predetermined cycle while the output of voltage wave in a cycle other than the predetermined cycle is damped enough to be capable of separating the voltage wave in the predetermined cycle. The "predetermined cycle" means a cycle corresponding to a frequency prepared in advance for output, such as about 90 kHz and about 110 kHz in one embodiment, and the "cycle other than the predetermined cycle" means, for example, an integral division of the predetermined cycle (a cycle of harmonic component).

The present invention may also be realized in various other forms, such as a residual quantity measuring apparatus, a residual quantity measuring control method, a residual quantity measuring control apparatus, and a computer program for realizing the functions of such a method or device by means of a computer, a computer-readable recording medium having such a computer program stored thereon, a data signal including such a computer program and embodied in a carrier wave, a print head, and a cartridge, and a combination thereof.

BEST MODES OF CARRYING OUT THE INVENTION

One mode of carrying out the invention is discussed below as a preferred embodiment in the following sequence:

A. Structure of Ink Cartridge in Embodiment of the Invention:

B. Electrical Structure of Ink Cartridge in Embodiment of the Invention:

C. Circuit Structure of Residual Ink Quantity Detection Unit in Embodiment of the Invention:

D. Residual Ink Quantity Measurement Process in Embodiment of the Invention:

E. Modifications:

A. Structure of Ink Cartridge

Figure 1:
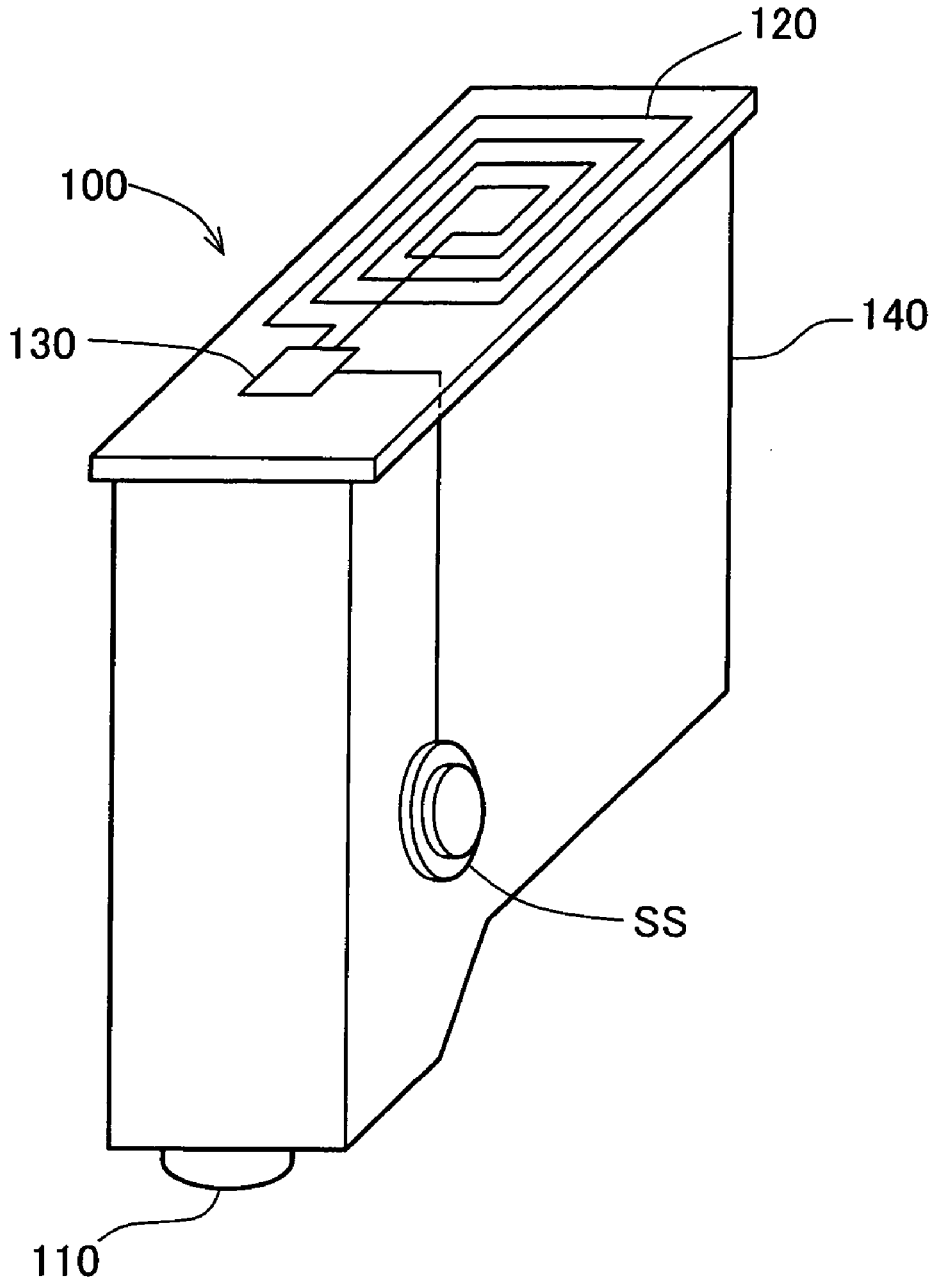
FIG. 1 is a perspective showing the appearance of an ink cartridge 100 in one embodiment of the invention.

FIG. 1 is a perspective showing the appearance of an ink cartridge 100 in the embodiment of the invention. The ink cartridge 100 has a casing 140 to keep one ink as an expendable therein. An ink supply port 110 is formed on the bottom of the casing 140 to feed ink to a printer as discussed below. An antenna 120 and a logic circuit 130 are located on the top of the casing 140 and are used to establish wireless communication with the printer. A sensor SS is attached to the side wall of the casing 140 and is used to measure a residual quantity of ink. The sensor SS is electrically linked to the logic circuit 130.

Figure 2A:
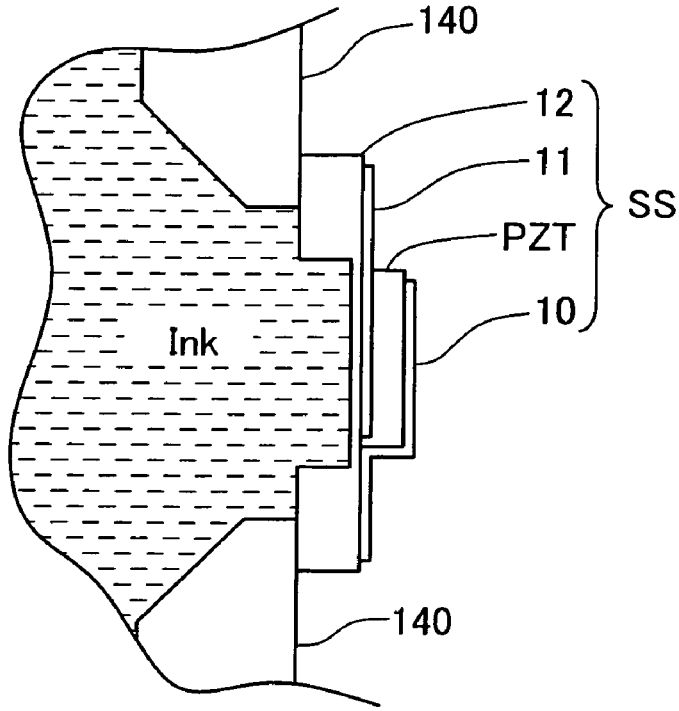
FIGS. 2(*a*), 2(*b*) are sectional views showing a sensor SS attached to side wall of a casing 140 of the ink cartridge 100.
Figure 2B:
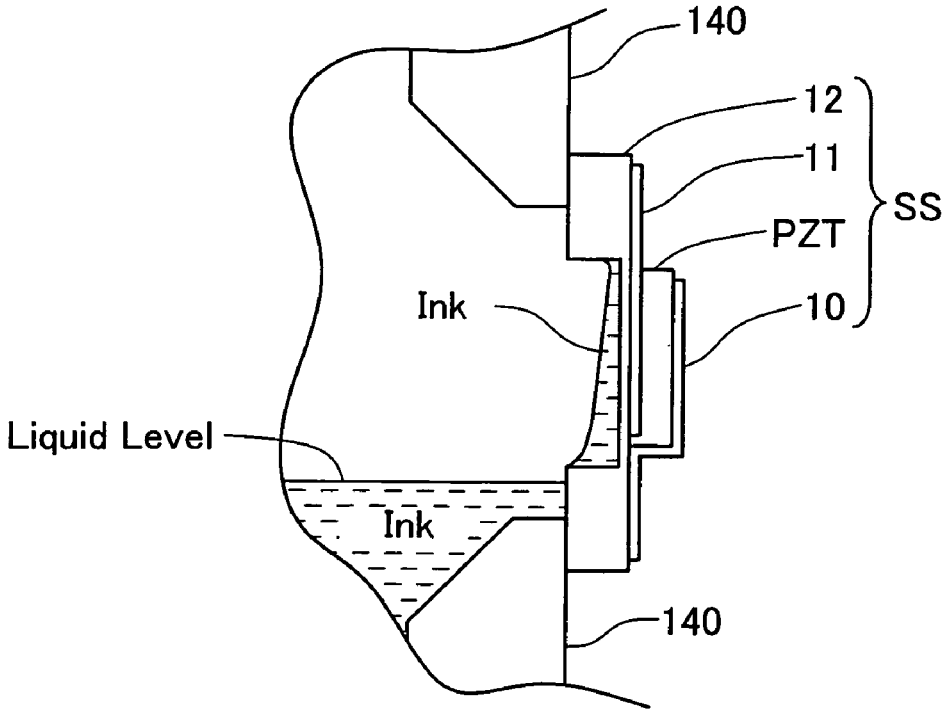

FIG. 2 is sectional views showing the sensor SS attached to the side wall of the casing 140 of the ink cartridge 100. The sensor SS includes a piezoelectric element PZT that has piezoelectric characteristics including piezoelectric effect and inverse piezoelectric effect, two electrodes 10 and 11 that function to apply a voltage to the piezoelectric element PZT, and a sensor attachment 12. The electrodes 10 and 11 are connected with the logic circuit 130. The sensor attachment 12 is a thin-film structural element of the sensor SS to transmit vibrations from the piezoelectric element PZT to the ink and the casing 140.

In the state of FIG. 2(*a*), the residual quantity of ink exceeds a preset level, and the liquid level of ink is higher than the position of the sensor SS (see FIG. 1). In the state of FIG. 2(*b*), the residual quantity of ink does not reach the preset level, and the liquid level of ink is lower than the position of the sensor SS. As clearly understood from these drawings, when the liquid level of ink is higher than the position of the sensor SS, the sensor SS, the casing 140, and all the ink work as a vibration body. When the liquid level of ink is lower than the position of the sensor SS, on the other hand, the sensor SS, the casing 140, and only a trace amount of ink adhering to the sensor SS work as a vibration body. This means that the vibration characteristics about the piezoelectric element PZT vary with a variation in residual quantity of ink. The technique of this embodiment takes advantage of such a variation of the vibration characteristics to measure the residual quantity of ink. The details of the measurement method will be discussed later.

B. Electrical Structure of Ink Cartridge

Figure 3:
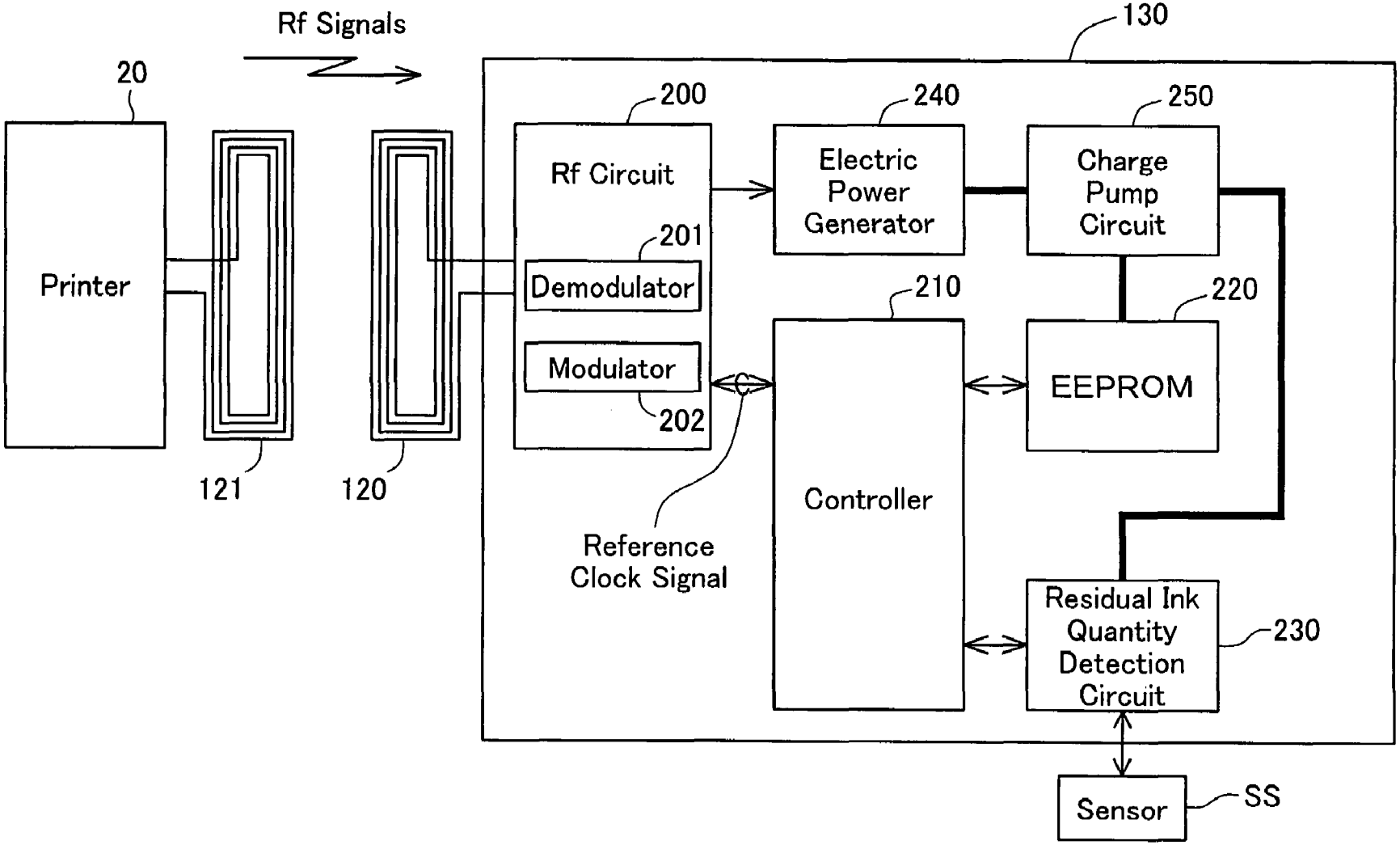
FIG. 3 is a block diagram showing a logic circuit 130 included in the ink cartridge 100.

FIG. 3 is a block diagram showing the logic circuit 130 included in the ink cartridge 100. The logic circuit 130 includes an RF circuit 200, a controller 210, an EEPROM 220 as a non-volatile memory, a residual ink quantity detection circuit 230, an electric power generator 240, and a charge pump circuit 250.

The RF circuit 200 has a demodulator 201 that demodulates radio wave received from a printer 20 via the antenna 12, and a modulator 202 that modulates signals received from the controller 210 and sends the modulated signals to the printer 20. The printer 20 uses its antenna 121 to send baseband signals on a carrier wave of a preset frequency to the ink cartridge 100. The ink cartridge 100, on the other hand, does not use a carrier wave but changes a load of its antenna 120 to vary an impedance of the antenna 121. The ink cartridge 100 takes advantage of such a variation in impedance to send signals to the printer 20. The ink cartridge 100 and the printer 20 establish two-way communication in this manner.

The RF circuit 200 also extracts a reference clock signal from AC power excited by the antenna 120. The extracted reference clock signal is supplied to the controller 210. The controller 210 generates a control clock signal as the basis for controlling the logic circuit 130 according to the reference clock signal. The logic circuit 130 may be configured to use the reference clock signal itself as the control clock signal.

The electric power generator 240 rectifies the carrier wave received by the RF circuit 200 and generates electric power of a specified voltage (for example, 5 V). The electric power generator 240 supplies the generated electric power to the RF circuit 200, the controller 210, the EEPROM 220, and the charge pump circuit 250. The charge pump circuit 250 boosts up the received electric power to a preset level of voltage demanded by the sensor SS and supplies the boosted-up electric power to the residual ink quantity detection circuit 230.

Figure 4:
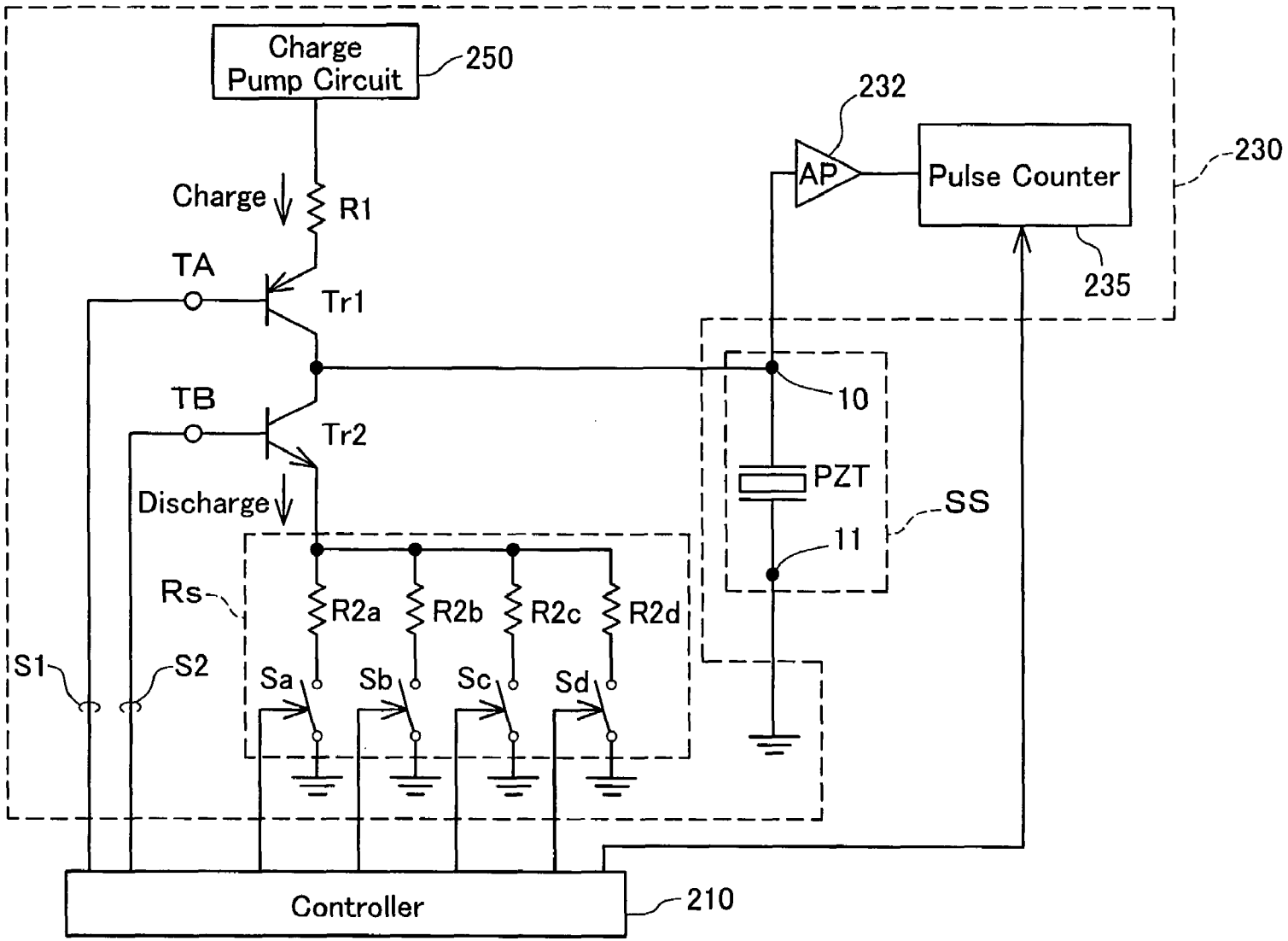
FIG. 4 is a circuit diagram showing the circuit structure of a residual ink quantity detection circuit 230 and the sensor SS.

C. Circuit Structure of Residual Ink Quantity Detection Unit in the Embodiment of the Invention FIG. 4 is a circuit diagram showing the circuit structure of the residual ink quantity detection circuit 230 and the sensor SS. The residual ink quantity detection circuit 230 includes a PNP transistor Tr1, an NPN transistor Tr2, a charge-time constant adjustment resistor R1, a discharge time constant adjustment resistive circuit Rs, an amplifier 232, and a pulse counter 235. The sensor SS is connected to the residual ink quantity detection circuit 230 by the two electrodes 10 and 11 (see FIG. 2).

The discharge time constant adjustment resistive circuit Rs has four discharge time constant adjustment resistors R2*a*, R2*b*, R2*c*, and R2*d* and four corresponding switches Sa, Sb, Sc, and Sd respectively connected therewith. The four switches Sa, Sb, Sc, and Sd are opened and closed by the controller 210. The controller 210 sets a value of resistance in the discharge time constant adjustment resistive circuit Rs by a combination of the open-close positions of these four switches Sa, Sb, Sc, and Sd.

The PNP transistor Tr1 has the following connections. Its base is linked to a terminal TA that receives a control output from the controller 210. Its emitter is linked to the charge pump circuit 250 via the charge-time constant adjustment resistor R1. Its collector is linked to one electrode 10 of the sensor SS, whereas the other electrode 11 of the sensor SS is grounded.

The NPN transistor Tr2 has the following connections. Its base is linked to a terminal TB that receives a control output from the controller 210. Its collector is linked to one electrode 10 of the sensor SS. Its emitter is grounded via the discharge time constant adjustment resistive circuit Rs with the variable setting of resistance.

The pulse counter 235 is connected with the electrode 10, which is linked to the piezoelectric element PZT, via the amplifier 232 that amplifies the output voltage of the piezoelectric element PZT. The pulse counter 235 is connected to the controller 210 to receive a control output from the controller 210.

Figure 5:
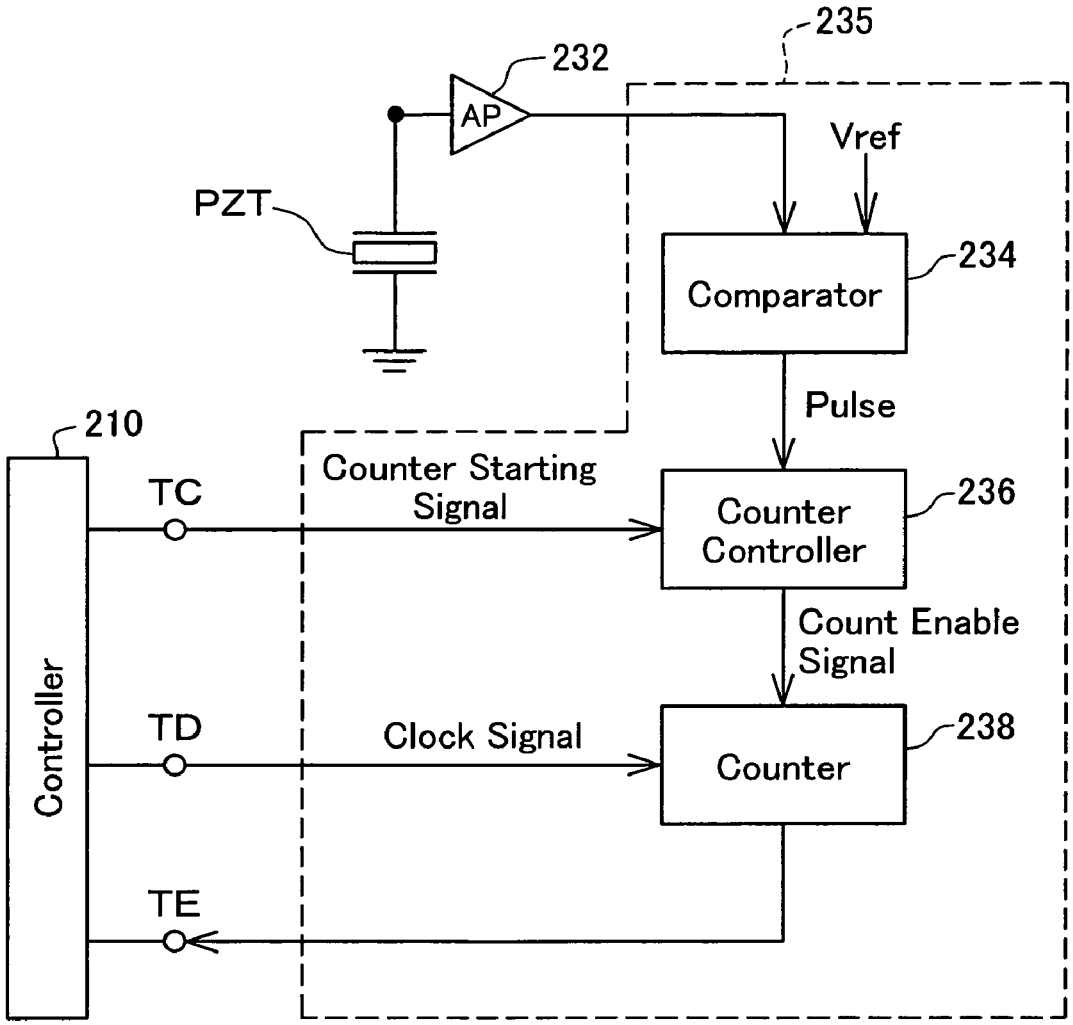
FIG. 5 is a block diagram showing the structure of a pulse counter 235 included in the residual ink quantity detection circuit 230.

FIG. 5 is a block diagram showing the structure of the pulse counter 235 included in the residual ink quantity detection circuit 230. The pulse counter 235 has a comparator 234, a counter controller 236, a counter 238, and a non-illustrated oscillator. The comparator 234 receives an output of the amplifier 232 as an object of analysis and a reference potential Vref. The counter controller 236 and the counter 238 are linked to the controller 210.

The residual ink quantity detection circuit 230 corresponds to the 'detection signal generation circuit' of the claimed invention.

D. Residual Ink Quantity Measurement Process in the Embodiment of the Invention

Figure 6:
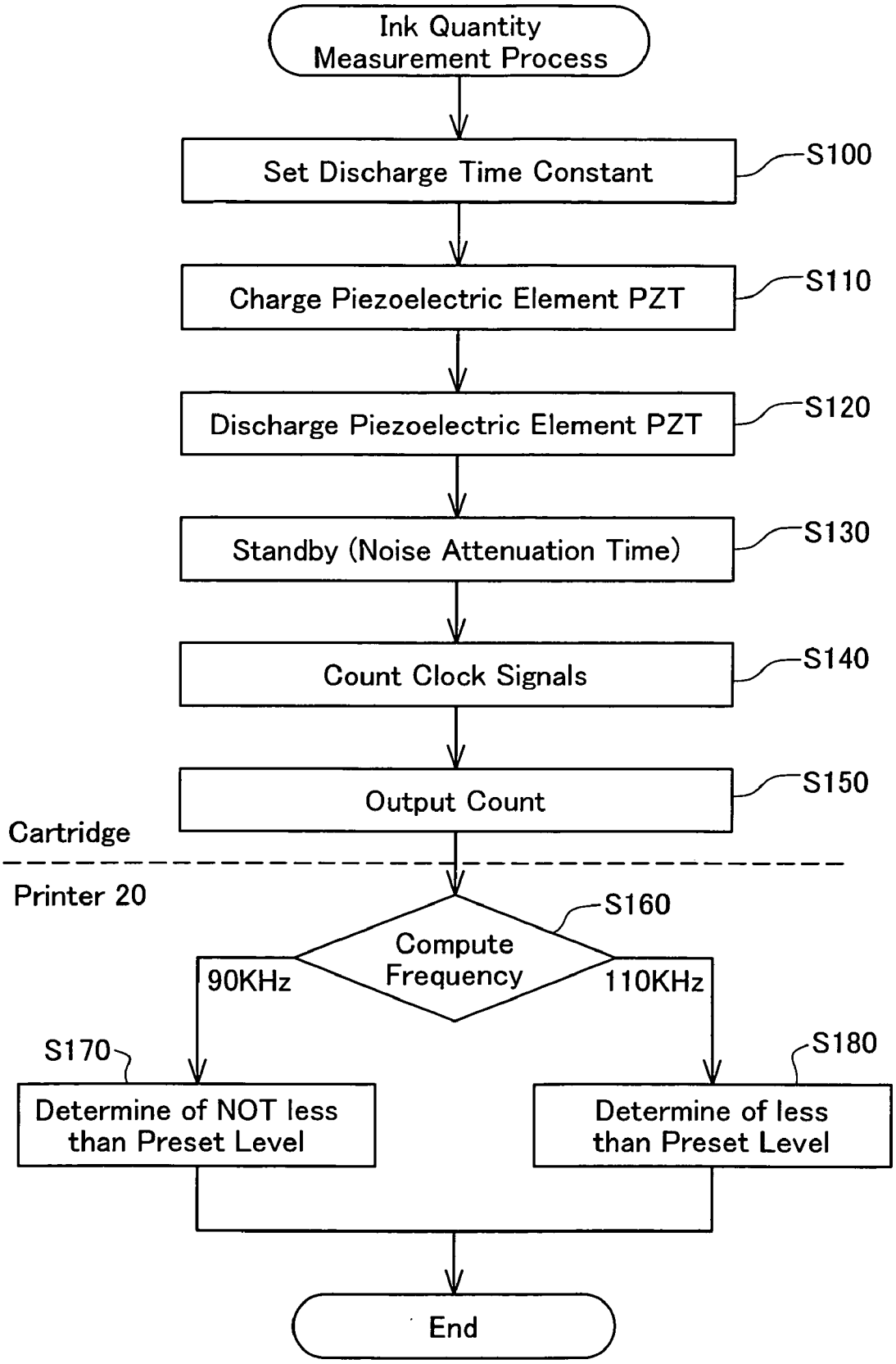
FIG. 6 is a flowchart showing a residual ink quantity measurement process executed in the embodiment of the invention.
Figure 7:
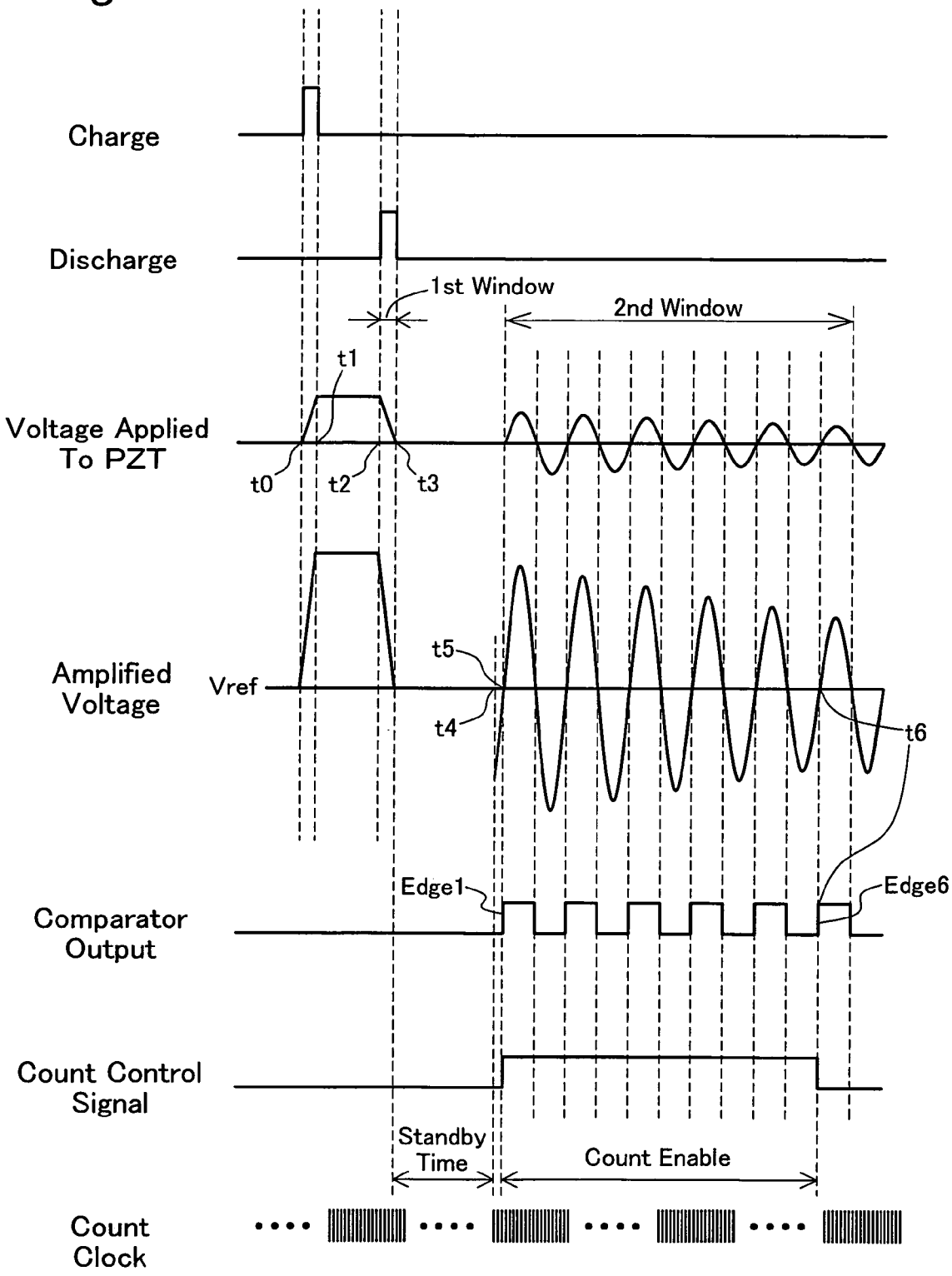
FIG. 7 is a timing chart showing the operations of the residual ink quantity detection circuit 230 and the sensor SS.

FIG. 6 is a flowchart showing a residual ink quantity measurement process executed in the embodiment of the invention. FIG. 7 is a timing chart showing the operations of the residual ink quantity detection circuit 230 and the sensor SS in this measurement process. This measurement process is executed by both the ink cartridge 100 and the printer 20, in response to the user's power switch-on operation of the printer 20. The ink cartridge 100 counts the number of clock signals CLK generated while the pulses of the output voltage wave from the piezoelectric element PZT reach a predetermined number (for example, 5). The printer 20 computes the frequency of the voltage wave from the count and estimates a remaining state of ink according to the computed frequency. The detailed procedure is discussed below.

At step S100, the controller 210 (see FIG. 4) regulates the open-close positions of the four switches Sa, Sb, Sc, and Sd included in the discharge time constant adjustment resistive circuit Rs to set a discharge time constant of the piezoelectric element PZT.

At step S110, the controller 210 (FIG. 4) outputs the control output signal to the terminal TA to switch the transistor Tr1 ON at the time t0. A flow of electric current then runs from the charge pump circuit 250 to the piezoelectric element PZT to apply a voltage onto the piezoelectric element PZT having a capacitance. In the initial stage, the two transistors Tr1 and Tr2 are both set OFF.

The controller 210 switches the transistor Tr1 OFF at the time point t1 and causes the residual ink quantity detection circuit 230 to stand by until the time point t2. The standby to the time point t2 attenuates the vibrations of the piezoelectric element PZT, which are caused by application of the voltage. The time point is measured by counting the number of pulses of the control clock signal using the controller 210.

At step S120, the controller 210 (FIG. 4) sends a preset control output signal to the terminal TB at the time point t2 to switch the transistor Tr2 ON at the time point t2 and OFF at the time point t3. This enables discharge of the piezoelectric element PZT for a time period between the time point t2 and the time point t3. The piezoelectric element PZT is deformed abruptly by the discharge to vibrate a sensor vibration system, which includes the sensor SS (FIG. 2), the casing 140 in the vicinity of the sensor SS, and ink.

Figure 8A:
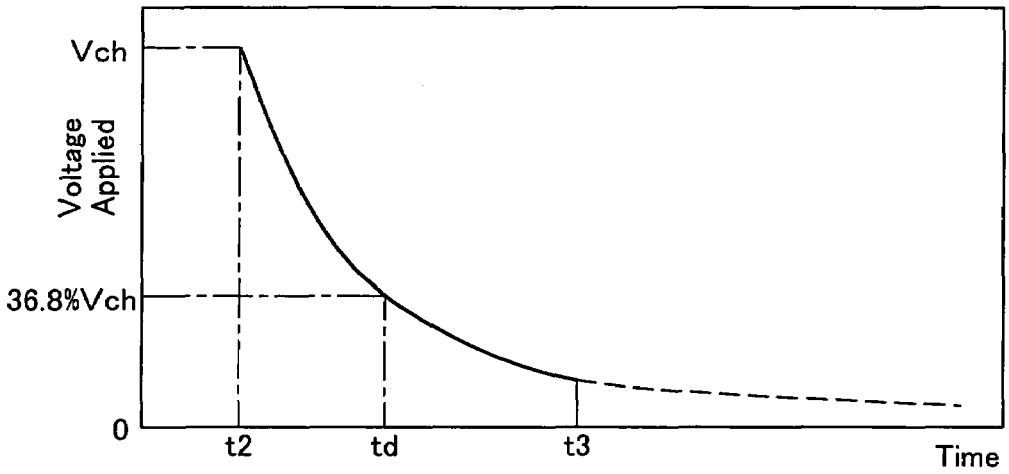
FIGS. 8(*a*), 8(*b*) show variations in applied voltage (potential difference from the grounding potential) of a piezoelectric element PZT.
Figure 8B:
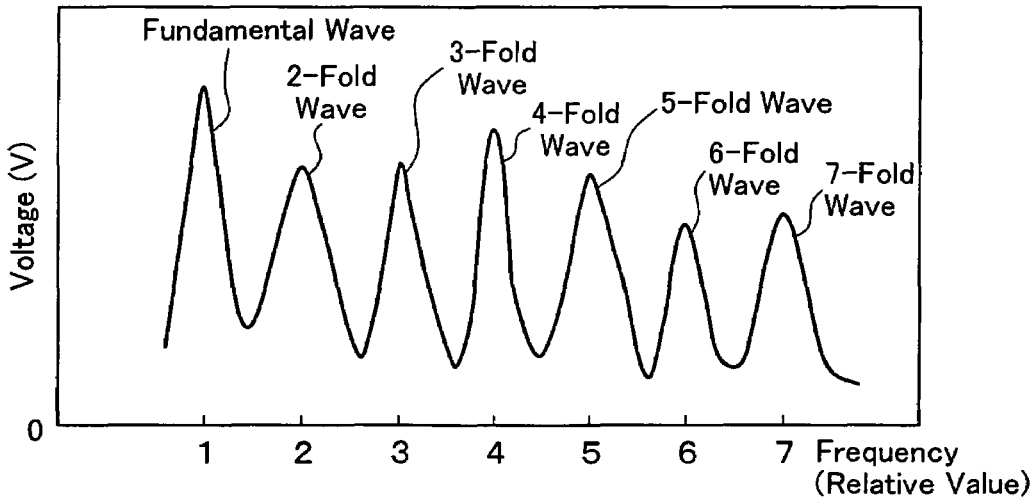

FIG. 8 shows a discharge waveform of the piezoelectric element PZT in the discharge time. FIG. 8(*a*) shows a discharge waveform in a time domain. The data given below show the potentials at respective time points:

(1) discharge start time t2: a potential Vch (an output potential of the charge pump circuit 250);

(2) time constant time td: a potential decreasing from the potential Vch by 63.2%; and (3) discharge end time t3: a potential slightly higher than the ground potential (see FIG. 8).

Here the time constant time td represents a time point when the time constant elapses from the discharge start time t2. In the specification hereof, the discharge time represents a time period between the discharge start time t2 and the discharge end time t3 when the piezoelectric element PZT is electrically connected with the grounding.

FIG. 8(*b*) shows a fundamental harmonic and multiple higher harmonics of the applied voltage in a frequency domain. This shows results of Fourier analysis of a hypothetic waveform on the assumption that the waveform of the applied voltage of the piezoelectric element PZT in the first window (FIG. 7) is repeated permanently. The voltage waveform of the applied voltage gives a fundamental harmonic having a fundamental frequency or the reciprocal of the discharge time and higher harmonics having frequencies of integral multiples. On condition that the deformation of the piezoelectric element PZT has a linear relation to the applied voltage, the waveform of the vibration force coincides with the waveform of the applied voltage.

Figure 9:
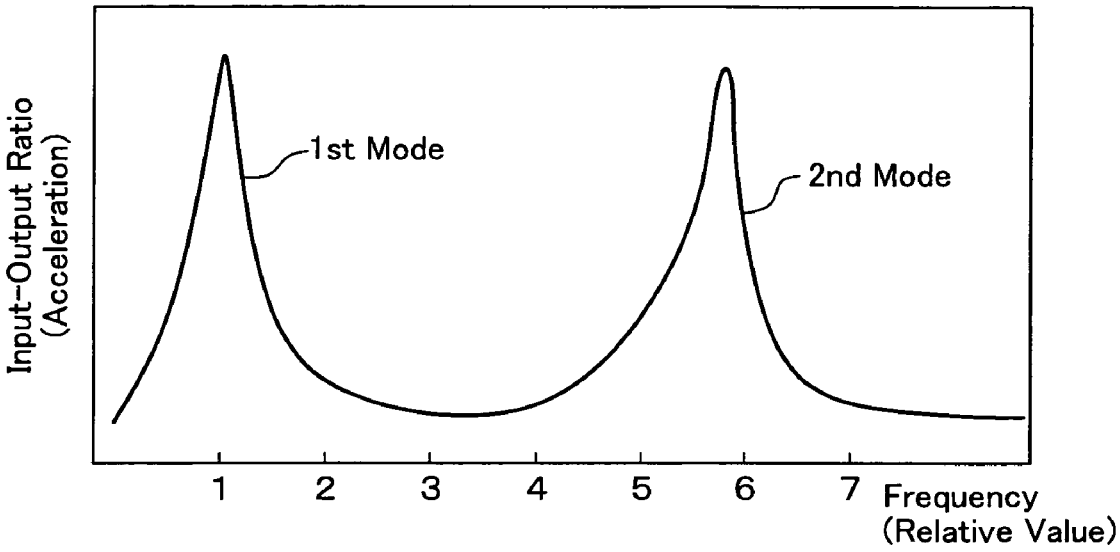
FIG. 9 shows a variation in frequency response function (Transfer Function) of a sensor vibration system including the sensor SS.

FIG. 9 shows variations in frequency response function (Transfer Function) of the sensor vibration system including the sensor SS. The frequency response function represents a relation between input and output of a vibration transmission system included in the sensor vibration system and is expressed by a ratio of an input Fourier spectrum to an output Fourier spectrum. The frequency response function of the embodiment is a ratio of a Fourier spectrum of the discharge waveform of the piezoelectric element PZT (having a linear relation to the vibration force) to a Fourier spectrum of the free vibration of the sensor vibration system.

The first mode and the second mode in FIG. 9 are two eigenmodes of the sensor vibration system. The eigenmode represents a vibration form of the sensor vibration system. Any object has a specific form in vibration and can not vibrate in any other form. This specific form corresponds to the eigenmode. The eigenmode of the object is identified by modal analysis.

It is assumed that the ink cartridge 100 has the following two vibration modes:

(1) In the first mode, a recess of the sensor SS (see FIG. 2) is deformed like a bowl with the edges of the recess as nodes of vibration and the center of the recess as the largest-amplitude area of vibration; and (2) In the second mode, the recess of the sensor SS is deformed like a seesaw with both the edges and the center of the recess as nodes of vibration and the left and right middle areas between the edges and the center as the largest-amplitude areas of vibration.

Application of vibration causes free vibration in the sensor vibration system only at eigenfrequencies of the first mode and the second mode. Even when the piezoelectric element PZT applies vibration to the sensor vibration system at any other frequencies, free vibration arising in the sensor vibration system is extremely small and is immediately attenuated.

Figure 10A:
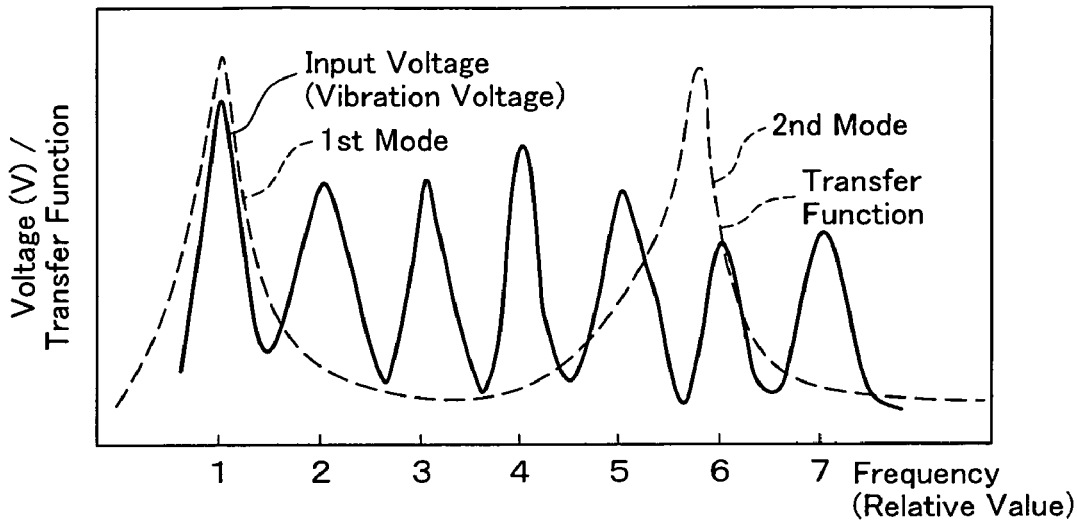
FIGS. 10(*a*), (*b*) show generation of voltage in the piezoelectric element PZT in response to discharge of the piezoelectric element PZT.
Figure 10B:
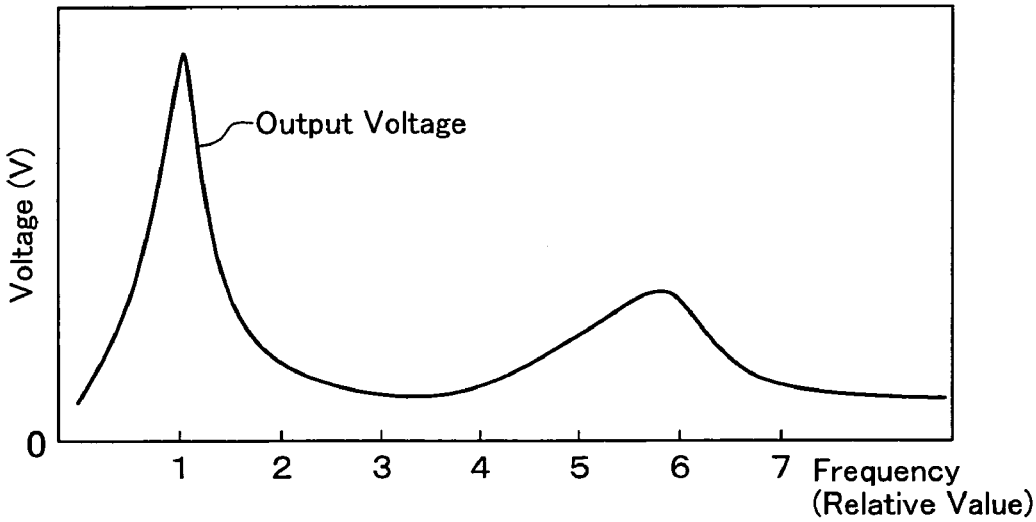

FIG. 10 shows generation of voltage in the piezoelectric element PZT in response to the free vibration of the piezoelectric element PZT. A solid line curve and a dotted line curve of FIG. 10(*a*) respectively show a waveform of the applied voltage (in the discharge time) in a frequency domain (see FIG. 8(*b*)), and the frequency response function in the sensor vibration system. FIG. 11(*b*) shows an output voltage of the piezoelectric element PZT.

As clearly understood from the graph of FIG. 10(*a*), the frequency of the fundamental harmonic of the discharge waveform is regulated to be substantially coincident with the eigenfrequency of the first mode in the sensor vibration system and to prevent the presence of any higher harmonic of the discharge waveform having a frequency coincident with the frequency of the second mode in the sensor vibration system. Significant free vibration accordingly arises only at the eigenfrequency of the first mode in the sensor vibration system. Namely a large voltage is generated in the piezoelectric element PZT only at the eigenfrequency of the first mode in the sensor vibration system (see FIG. 10(*b*)). This agrees well with the results of Fourier analysis of a hypothetic waveform on the assumption that the waveform of the output voltage of the piezoelectric element in the second window(see FIG. 7) is repeated permanently. The standby time terminates at the time point t4 as mentioned above.

The procedure of the embodiment utilizes a subtle shift of the eigenfrequency of the first mode in the sensor vibration system to measure the liquid level of ink. The eigenfrequency of the first mode subtly shifts depending upon whether the liquid level of ink is higher than the position of the sensor SS. The positional relation between the sensor SS and the liquid level of ink is determined according to this subtle shift. The voltage waveform at the other frequencies is recognized as noise.

At step S130 (see FIG. 6), the controller 210 causes the residual ink quantity detection circuit 230 to stand by again for a time period between time points t3 and t4 in FIG. 7. This standby time is set for attenuation of unwanted vibrations as the noise source. The vibrations at the frequencies other than the eigenfrequencies of the first mode and the second mode are attenuated to practically disappear in the standby time.

The standby time is measured by counting the number of pulses of the control clock signal using the controller 210. The reason will be described later for using the control clock signal to measure the standby time.

The controller 210 (FIG. 5) outputs a counter starting signal to the counter controller 236 at the time point t4. The counter controller 236 receives the counter starting signal and outputs a count enable signal to the counter 238. The output of the count enable signal starts at a first rising edge Edge1 of a comparator output after the reception of the counter enable signal (at a time point t5) and terminates at a sixth rising edge Edge6 (at a time point t6). Although the grounding potential is set to the reference potential Vref used as the reference for comparison in the comparator 234, the reference potential Vref may be shifted from the grounding potential so as to ensure the elimination of noise.

At subsequent step S140, the counter 238 counts the number of pulses of the control clock signal. Counting the number of pulses of the control clock signal is carried out only while the counter 238 receives the count enable signal. The number of pulses of the control clock signal is accordingly counted for a time period between the first rising edge Edge1 and the sixth rising edge Edge6 of the comparator output. The procedure counts up the number of pulses of the control clock signal corresponding to five cycles of the voltage wave output from the piezoelectric element PZT.

At step S150, the counter 238 outputs the resulting count, which is sent to the printer 20. The printer 20 calculates the frequency of the voltage wave output from the piezoelectric element PZT based on the received count and a known control clock cycle.

At step S160, the printer 20 determines whether the residual quantity of ink exceeds the preset level, based on the calculated frequency. For example, it is assumed that the frequency is about 90 kHz when the liquid level of ink is higher than the position of the sensor SS, while being about 110 kHz when the liquid level of ink is lower than the position of the sensor SS. In this example, when the calculated frequency is 105 kHz, it is determined that the residual quantity of ink does not reach the preset level (steps S170 and S180).

As described above, the cycle of the voltage wave output from the piezoelectric element PZT is measured by counting the voltage waves and using the time period where the predetermined number of voltage waves occur. On the contrary, the standby time is measured by counting the control clock signal rather than the voltage waves. This is intended to eliminate the effect of manufacturing variability of sensor SS on the standby time and thereby ensure the accurate measurement of the standby time.

The effect of manufacturing variability of sensor SS on the standby time is primarily due to the harmonic component (FIG. 8(*b*)) which occurs in the voltage applied to the sensor SS. That is, the occurring amount of harmonic component varies depending on the manufacturing variability of sensor SS. Accordingly, the standby time also varies depending on the variation in the occurring amount of harmonic components if the standby time is determined based on the count of voltage pulses. This results in a problem that the standby time may be too short to sufficiently damp the unnecessary vibration as the noise source (the voltage wave other than the voltage wave in the eigenfrequency of the first mode) if the occurring amount of harmonic components is large, for example.

In this embodiment, the standby time is determined by counting the control clock signal using the controller 210, and thereby reducing the variation in the standby time, which is caused by the manufacturing variability of expendable container including that of piezoelectric element. This enhances the reliability of the measurement.

E. Modifications

The embodiments discussed above are to be considered in all aspects as illustrative and not restrictive. There may be many modifications, changes, and alterations without departing from the scope or spirit of the main characteristics of the present invention. Some examples of possible modification are given below.

E-1. The piezoelectric element PZT used as the sensor element in the above embodiments may be replaced by Rochelle salt (potassium sodium tartrate). The sensor used in this invention is to take advantage of a piezoelectric element having two characteristics, that is, inverse piezoelectric effect of deformation by charge or discharge and piezoelectric effect of generation of voltage due to deformation.

E-2. Although the standby time is determined by counting the control clock signal which is generated according to the reference clock signal externally supplied to the logic circuit 130 in the above embodiments, the logic circuit 130 may include an internal reference crystal oscillator therein.

E-3. In the above embodiments, the subject of measurement of the residual quantity is ink. Another possible subject of measurement is toner. In general, the subject of measurement of the residual quantity in the invention may be any expendable that decreases in quantity with use of a device.

E-4. In the above embodiments, the subject of measurement of the residual quantity is ink. Another possible subject of measurement is toner. In general, the subject of measurement of the residual quantity in the invention may be any expendable that decreases in quantity with use of a device.

E-5. Although the residual ink quantity detection unit 230 and the controller 210 are included within the ink cartridge 100 in the above embodiments, at least one of the residual ink quantity detection unit 230 and controller 210 may be located outside the ink cartridge 100 such as within the printer 20.

Although the ink cartridge 100 communicates with the printer 20 in a contactless manner, an electric contact may be used for the communication.

When part or all of the functions of the invention are attained by the software configuration, the software (computer programs) may be stored in computer-readable recording media. The terminology 'computer-readable recording media' in this invention is not restricted to portable recording media, such as flexible disks and CD-ROMs, but also includes internal storage devices of the computer like diverse RAMs and ROMs, as well as external storage devices connected to the computer, such as hard disk units.

Finally, the Japanese Patent Application (Patent Application No. 2003-182354 (Application date: Jun. 6, 2003)) on which the priority claim of this application is based is incorporated by reference in the disclosure.

INDUSTRIAL APPLICABILITY

The technique of the present invention is applicable to expendable containers used for output devices of the computer.

The invention claimed is:

1. An apparatus configured to receive an expendable from an expendable container with a piezoelectric element attached, the apparatus comprising:

a detection signal generation circuit configured to charge and discharge the piezoelectric element, and generate a detection signal including information representing a cycle of remaining vibration of the piezoelectric element after a lapse of a predetermined standby time from a completion of the discharge; and a controller configured to generate a clock signal, and control the charge and the discharge of the piezoelectric element, wherein the cycle is available for determining whether a residual quantity of the expendable is greater than a preset level, and the controller is configured to determine the predetermined standby time by counting a number of pulses in the clock signal.

2. The apparatus in accordance with claim 1, wherein the controller is capable of changing the predetermined standby time.

3. An expendable container capable of measuring a residual quantity of stored expendable, the expendable container comprising:

an expendable tank configured to store the expendable and have a piezoelectric element attached;

a detection signal generation circuit configured to charge and discharge the piezoelectric element, and generate a detection signal including information representing a cycle of remaining vibration of the piezoelectric element after a lapse of a predetermined standby time from a completion of the discharge; and a controller configured to generate a clock signal, and control the charge and the discharge of the piezoelectric element, wherein the cycle is available for determining whether a residual quantity of the expendable is greater than a preset level, and the controller is configured to determine the predetermined standby time by counting a number of pulses in the clock signal.

4. The expendable container in accordance with claim 3, wherein the controller is capable of changing the predetermined standby time.

5. The expendable container in accordance with claim 3, wherein the controller generates the clock signal in response to a signal provided from outside of the expendable container.

6. An expendable container capable of measuring a residual quantity of stored expendable, the expendable container comprising:

an expendable tank configured to store the expendable; and a piezoelectric element attached to the expendable tank, wherein the piezoelectric element is configured to charge and discharge in response to an electric current provided from an outside apparatus, and output a voltage wave only in an predetermined frequency in response to a remaining vibration of the piezoelectric element after a lapse of a predetermined standby time from a completion of the discharge, wherein the predetermined frequency is available for determining whether a residual quantity of the expendable is greater than a preset level, and the predetermined standby time is determined by counting a number of pulses in a clock signal generated by the outside apparatus.

7. A method of measuring a residual quantity of expendable stored in an expendable container, the method comprising the steps of:

(a) providing an expendable tank configured to store the expendable and have a piezoelectric element attached, and a circuit configured to charge and discharge the piezoelectric element;

(b) generating a clock signal;

(c) charging the piezoelectric element;

(d) discharging the piezoelectric element;

(e) waiting a lapse of a predetermined standby time from a completion of the discharge;

(f) generating a detection signal including information representing a cycle of remaining vibration of the piezoelectric element after the lapse of a predetermined standby time;

(g) determining whether a residual quantity of the expendable stored in the expendable tank is greater than a preset level, according to the detection signal; and the step (e) includes the step of determining the predetermined standby time by counting a number of pulses in the clock signal.

8. The method in accordance with claim 7, wherein the step (e) further includes the step of changing the predetermined standby time.

9. The expendable container in accordance with claim 4, wherein the controller generates the clock signal in response to a signal provided from outside of the expendable container.

* * * * *